United States Patent [19]

Hurn et al.

[11] Patent Number: 4,476,602

[45] Date of Patent: Oct. 16, 1984

[54] PORTABLE ELECTRIC SCRUBBER

[75] Inventors: Richard L. Hurn, Ridgely; Gregory C. Harris, Easton; Herman P. Cox, Ridgely, all of Md.

[73] Assignee: Black & Decker, Inc., Newark, Del.

[21] Appl. No.: 408,022

[22] Filed: Aug. 13, 1982

[51] Int. Cl.[3] ..... A46B 13/02

[52] U.S. Cl. ..... 15/28; 51/170 T; 285/398; 310/50

[58] Field of Search ..... 15/22 R, 23, 24, 28, 15/29, 97; 277/206.1; 285/371, 398; 310/50; 51/170, 170 T

[56] References Cited

U.S. PATENT DOCUMENTS

| | | | |
|---|---|---|---|
| 1,921,642 | 8/1933 | Stephenson | 285/398 |
| 2,221,315 | 11/1940 | Okun | 15/49 R X |
| 2,320,379 | 6/1943 | Niekamp . | |
| 3,011,815 | 12/1961 | Guite . | |
| 3,344,455 | 10/1967 | Pauler et al. | 15/50 R |
| 4,158,246 | 6/1979 | Meadows et al. | 15/28 |
| 4,168,560 | 9/1979 | Doyel | 15/29 |

*Primary Examiner*—Edward L. Roberts

*Attorney, Agent, or Firm*—Finnegan, Henderson, Farabow, Garrett & Dunner

[57] ABSTRACT

A portable electric scrubber in which the drive shaft and gear assembly and drive motor are secured together in a fixed relationship by a one-piece gear case secured within a compartment defined between to halves of a housing. The output shaft includes integral, deflectable cantilever beams having ridges for engaging a central hole in an attachment. The housing is sealed by a one-piece seal which seals between the housing halves, around the output shaft and over an actuation button.

15 Claims, 12 Drawing Figures

FIG. 3
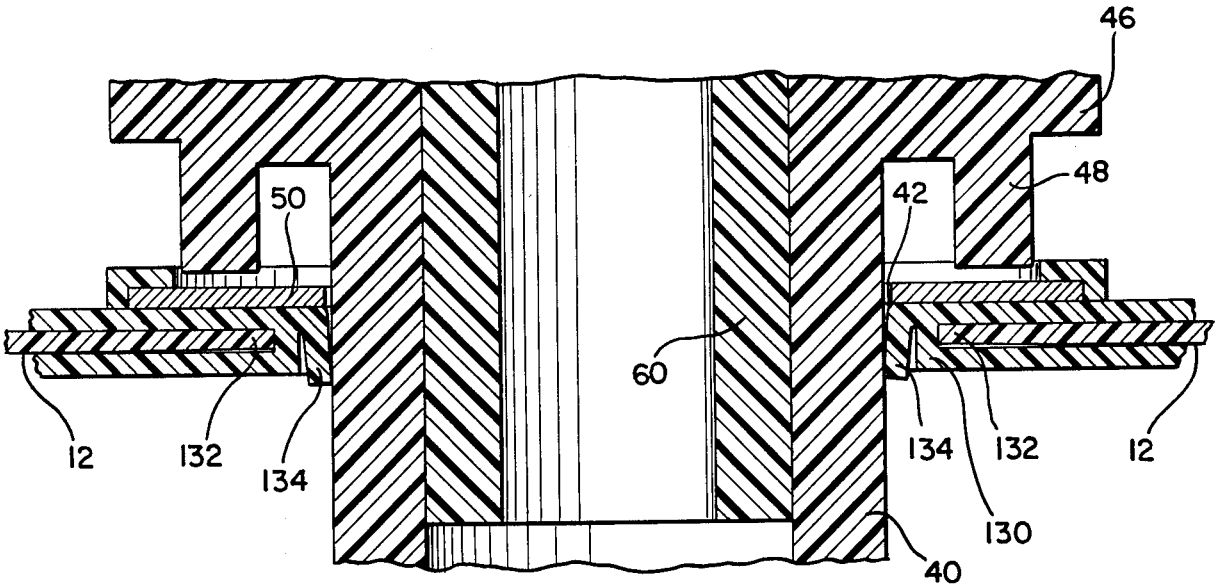
FIG. 4
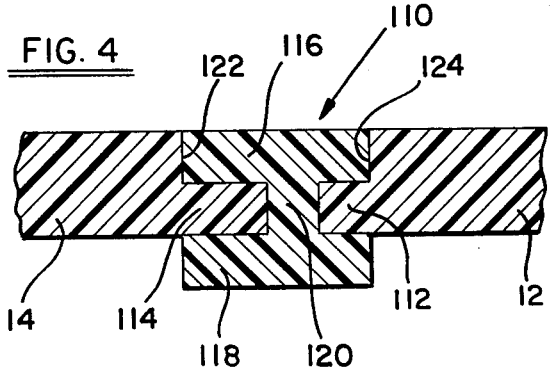
FIG. 6
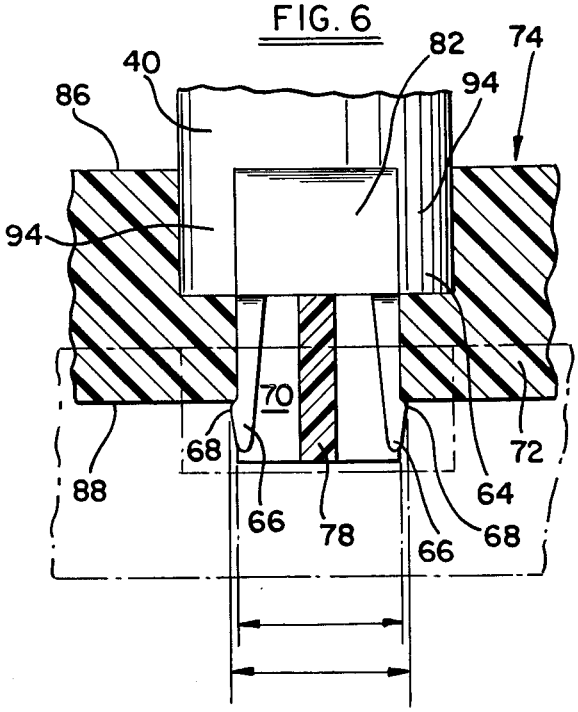
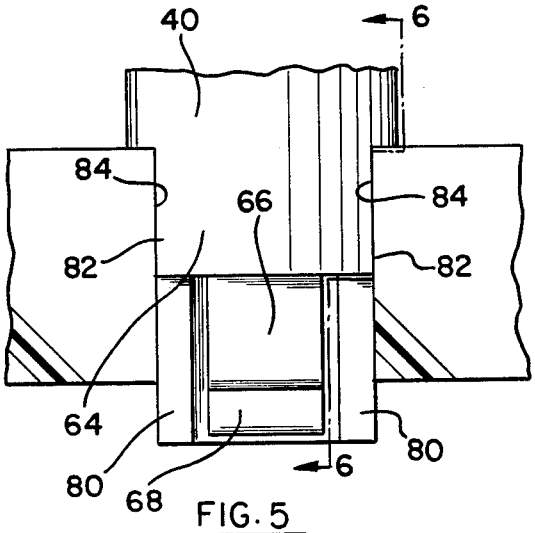
FIG. 5

FIG. 7
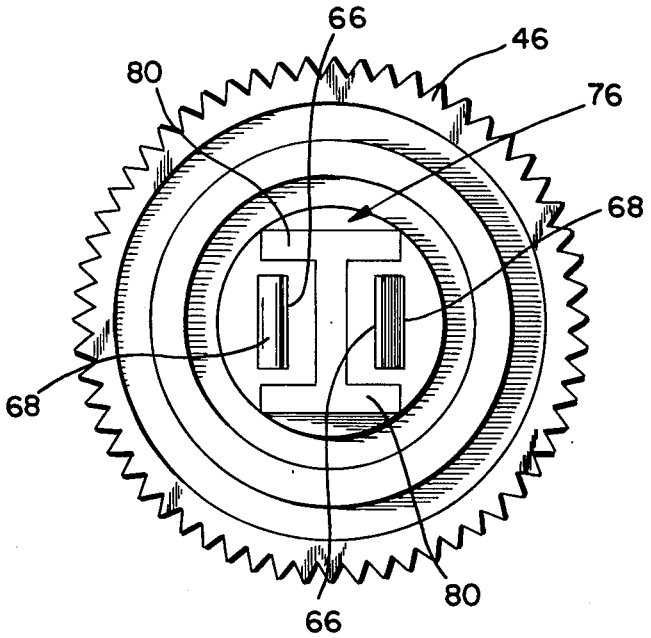
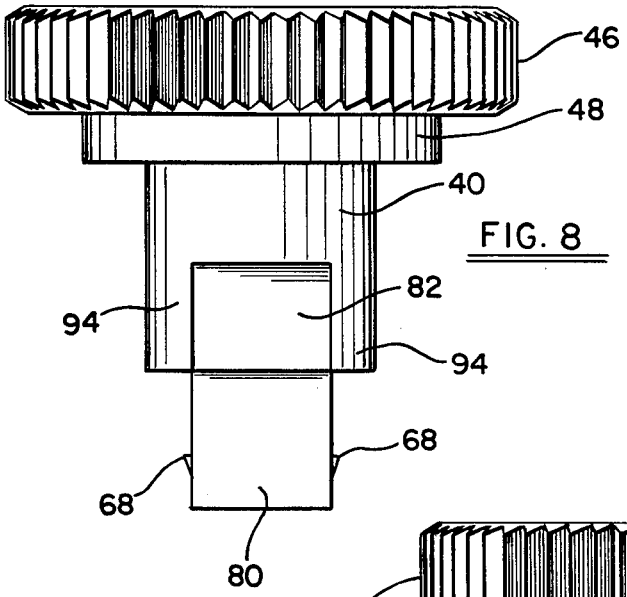
FIG. 8
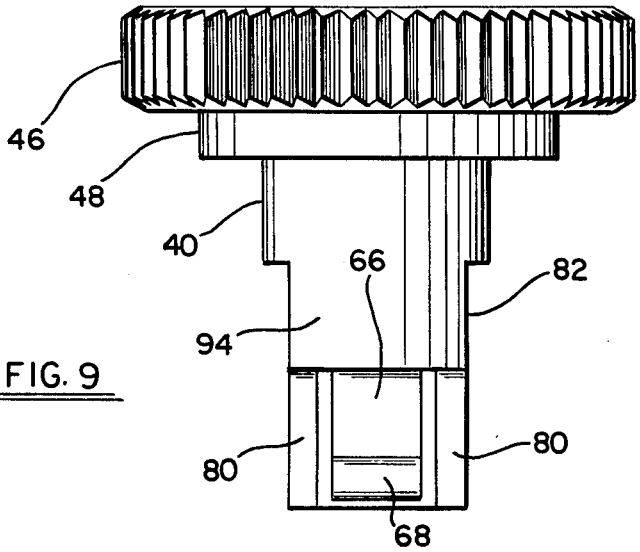
FIG. 9

FIG. 10
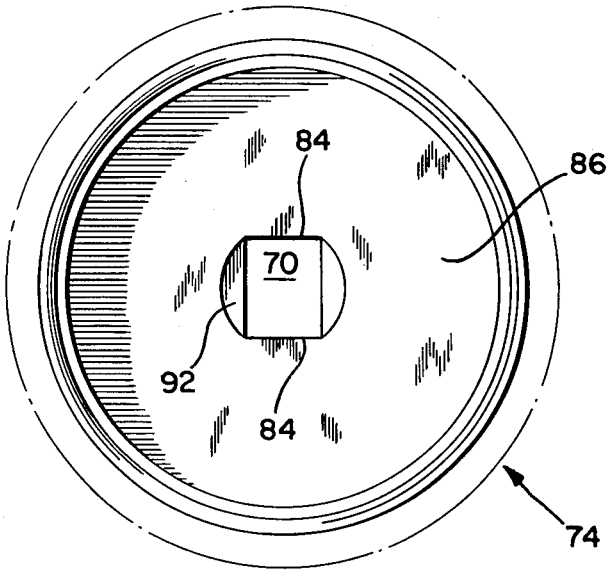
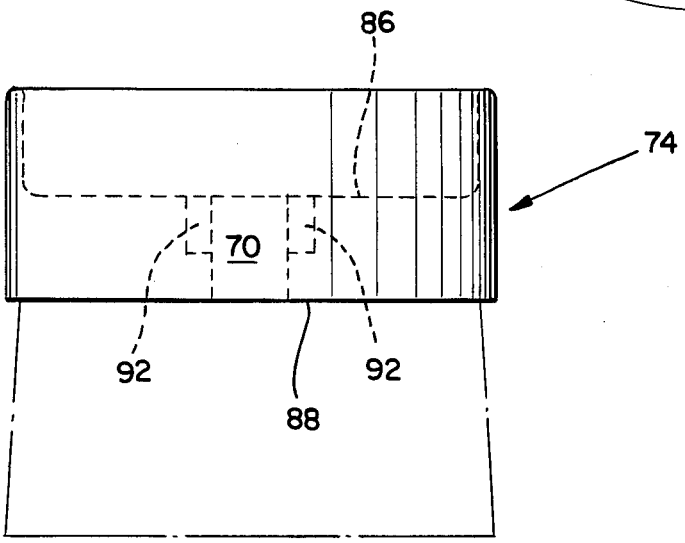
FIG. 11
FIG. 12
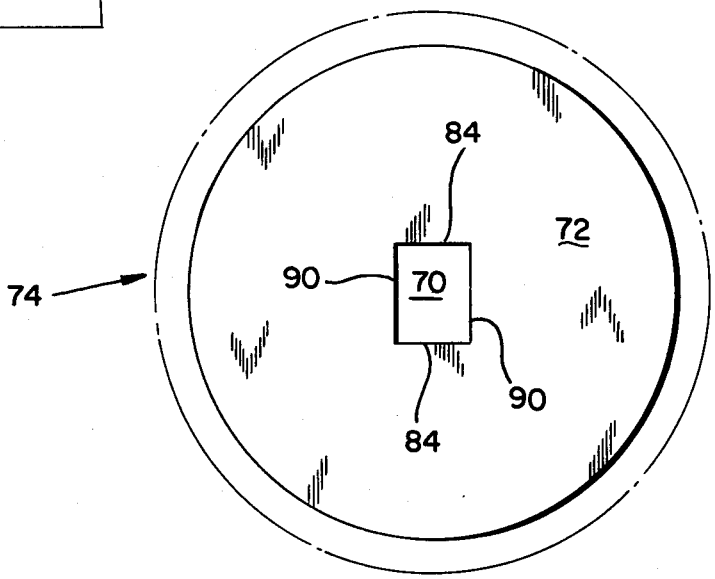

PORTABLE ELECTRIC SCRUBBER

BACKGROUND OF THE INVENTION

1. Field of the Invention

This invention relates to portable, electrically-powered brushing and scrubbing devices and, particularly, to hand-held, battery powered devices of this nature.

2. Description of the Prior Art

It is known in the prior art to provide battery-powered devices having removable attachments for scrubbing, polishing cleaning and the like. Such devices have been disclosed in U.S. Pat. Nos. 4,005,502, 4,027,348, 4,052,766, and 4,158,146.

In general, such prior art devices include a self-contained housing incorporating a power source, such as a battery, a drive motor, a gear and drive shaft assembly, and a switch for activating a drive motor. An output shaft extends outside the housing and is driven by the drive motor through the gear and drive shaft assembly for rotating or oscillating an attachment, such as a brush or pad, secured to the end of the drive shaft.

The prior art devices have presented several drawbacks in their manufacture. For example, in prior art devices the gear and drive shaft assembly includes a double reduction gear set consisting of a simple supported output shaft and gear, a simple supported combination gear and pinion and gear shafts which are separately supported by a gear case, which usually surrounds the entire gear set, and a motor mounting bracket. The motor is generally attached to the motor mounting bracket and the reduction gear set.

Several steps are involved in assembling the drive shaft and gear assembly within the casing of the prior art devices increasing the manufacturing costs. Furthermore, because of the many separate elements involved, extreme accuracy is needed to ensure that the elements are mounted in the proper relationship to ensure bearing alignment and shaft alignment with the motor in the mounting bracket. Where there are various tolerances for the various elements, a tolerance build-up may develop which results in a misalignment.

Another aspect of manufacture which increases cost and the risk of defective products is sealing the housing to prevent liquid contaimination of the electrical and gear components contained within the housing.

The instant invention has overcome many of the disadvantages of prior art devices as it relates to efficient and accurate assembly of the devices and efficient sealing of the housing to prevent liquid contamination. In particular, the instant invention provides a one-piece gear case secured to the drive motor and supporting all of the elements of the gear and drive shaft assembly to ensure uniform alignment. Such a structure leads to a highly efficient, consistent gear set performance. Additionally, the instant invention incorporates a one-piece seal providing effective sealing against liquid contamination as well as an efficient means of assembly of the device.

Additional advantages of the invention are set forth in part in the description which follows, and in part will be obvious from the description, or may be learned by practice of the invention. The objects and advantages of the invention may be realized and attained by means of the instrumentalities and combinations particularly pointed out in the appended claims.

SUMMARY OF THE INVENTION

As embodied and broadly described herein, the portable scrubber of this invention comprises a housing formed of two half-sections secured together and defining an internal compartment; a drive motor supported by the housing in the compartment and including a motor shaft and a first drive gear mounted thereon; a combination gear rotatably disposed on a shaft parallel to the motor shaft which includes a reducing gear driven by the first drive gear and a second drive gear coaxially and integrally formed with the reducing gear for rotation at a speed reduced from that of the first drive gear; a hollow, tubular output shaft rotatably disposed in an opening in the housing having one end disposed in the compartment; an output gear coaxially secured to the one end of the output shaft and being driven by the second drive gear; a one-piece gear case supported by the housing in the compartment for supporting the shaft of the combination gear and rotationally supporting the output gear in fixed relationship to each other and to the drive motor, the axis of the output shaft being parallel and proximate to the axis of the motor shaft; attachment means on the other end of the output shaft for releasably engaging an attachment for rotating the attachment with the output shaft; actuator means manually accessible through an opening in the housing for electrically connecting the drive motor to an electrical power source; and one-piece seal means for sealing against liquid passage between the two-halves of the housing, around the output shaft, and through the opening for the actuator means.

Preferably, the gear case comprises a plate secured to the drive motor, an integral, cantilever extension of the plate for fixedly receiving the shaft of the combination gear, and an integral member depending from the plate, the member including an annular shoulder for slidably abutting the one end of the output shaft and a cylindrical bearing surface received in the bore of the output shaft for rotatably supporting the output gear.

It is preferred that the gear case and the output shaft be plastic having a low coefficient of friction and a high wear factor to eliminate the necessity for bearings between the bore surface of the output shaft and the cylindrical bearing surface of the gear case.

It is also preferred that the attachment means comprise a pair of spaced, parallel cantilever beams substantially parallel to the axis of and extending from the other end of the output shaft, each said beam including a transverse ridge projecting outwardly from the axis of the shaft and the beams being inwardly deflectable to permit passage of the beams through a central hole in an attachment for releasably securing the attachment to the output shaft; an H-shaped shield axially extending from the other end of the output shaft, the central member of the shield being disposed between the cantilever beams and the opposed cross members of the shield protecting the sides of the cantilever beams without restricting deflection of the beams or preventing the transverse ridges from engaging the central hole; and a pair of opposed flat portions on the surface of the output shaft at the other end thereof, each flat portion being axially adjacent to and substantially coplanar with a respective one of the opposed cross members of the shield for drivingly engaging corresponding flat portions of the central hole.

Preferably the seal means comprises a molded polyurethane seal in a substantially planar loop having an H-shaped cross section, the opposed edges of the two halves of the housing being seated between the legs of the seal placing the center member in compression; a flexible, thumb-sized dome integrally formed in the seal, the dome sealingly engaging the edges of the housing halves defining the opening for access to the actuator means and flexibly covering the actuator means; and a seal ring integrally formed in the seal and engaging the edges of the housing halves defining the opening in which the output shaft is disposed, the ring including an annular V-shaped seal element sealingly engaging the surface of the output shaft.

The accompanying drawings, which are incorporated in and constitute a part of the specification, illustrate one embodiment of the invention and together with the description, serve to explain the principles of the invention.

BRIEF DESCRIPTION OF THE DRAWINGS

FIG. 3 is an enlarged view of a portion of the cutaway part of the scrubber depicted in FIG. 1.

FIG. 4 is a cross-sectional view taken along lines 4—4 of FIG. 1.

FIG. 5 is a partial cut away view of the relationship of the attachment means on the end of the drive shaft with the attachment.

FIG. 6 is a view of the attachment means taken along lines 6—6 in FIG. 5.

FIG. 7 is an enlarged bottom view of the output shaft and output gear unit.

FIG. 8 is a side view of the output gear and output shaft unit.

FIG. 9 is a side view 90° to the view of FIG. 8 of the output shaft and output gear unit.

FIG. 10 is a top view of the attachment.

FIG. 11 is a side view of the attachment depicted in FIG. 10.

FIG. 12 is a bottom view of the attachment depicted in FIG. 11.

DESCRIPTION OF THE PREFERRED EMBODIMENT

Figure 1:
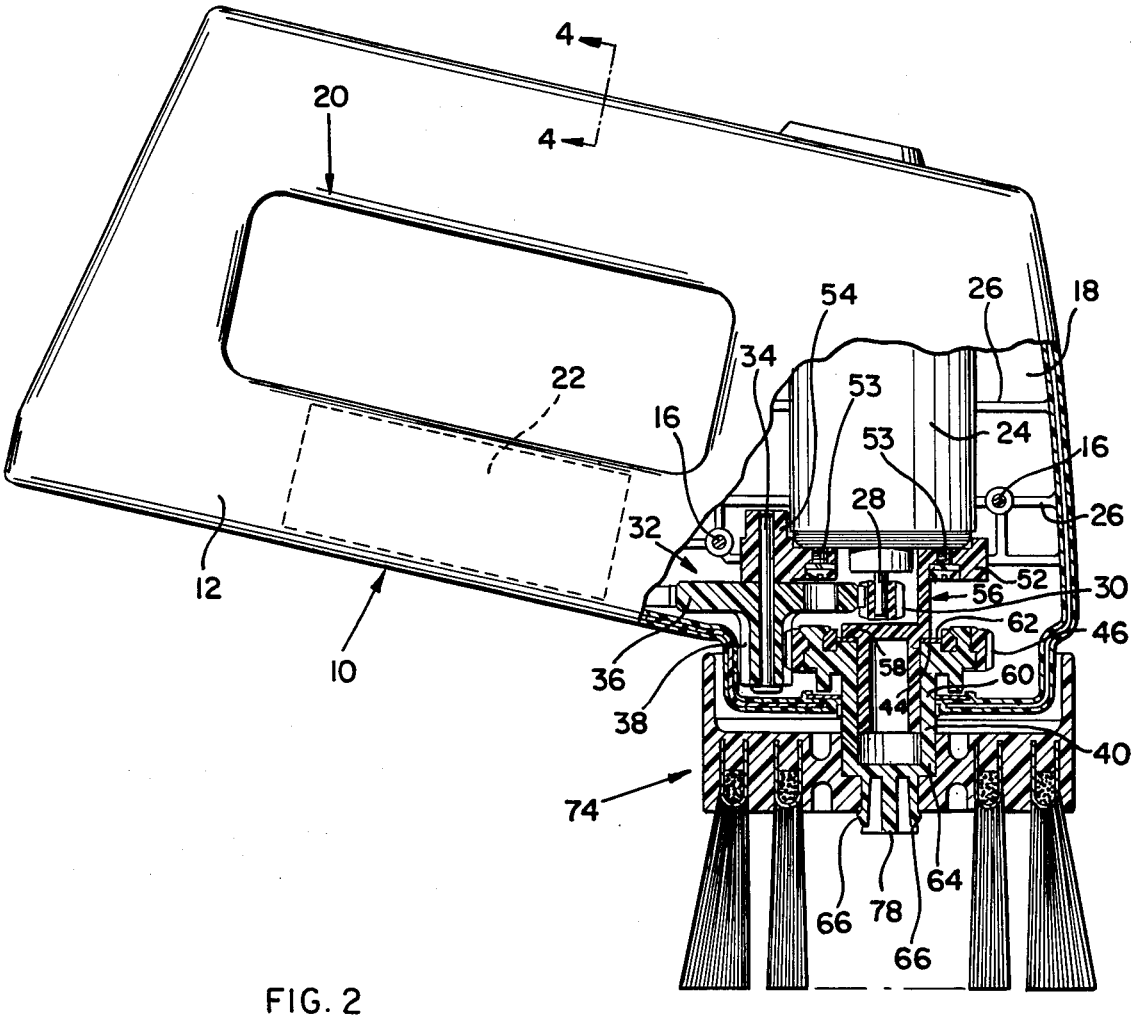
FIG. 1 is a side elevation view of the portable scrubber of the invention with a fragmentary sectional view of the internal motor, gear and shaft mechanism.

Reference will now be made in detail to the present preferred embodiment of the invention, an example of which is illustrated in the accompanying drawings.

In accordance with the invention, the portable scrubber comprises a housing formed of two half-sections, secured together defining an internal compartment. Preferably, as may be seen in FIGS. 1 and 4, the housing 10 includes a right section 12, and a left section 14 secured together by means of screws 16, or other securing means, and defining an internal compartment 18. As here embodied, the housing 10 also includes a grip portion 20 and a second internal compartment 22 for containing a battery providing electrical power for the scrubber.

Figure 2:
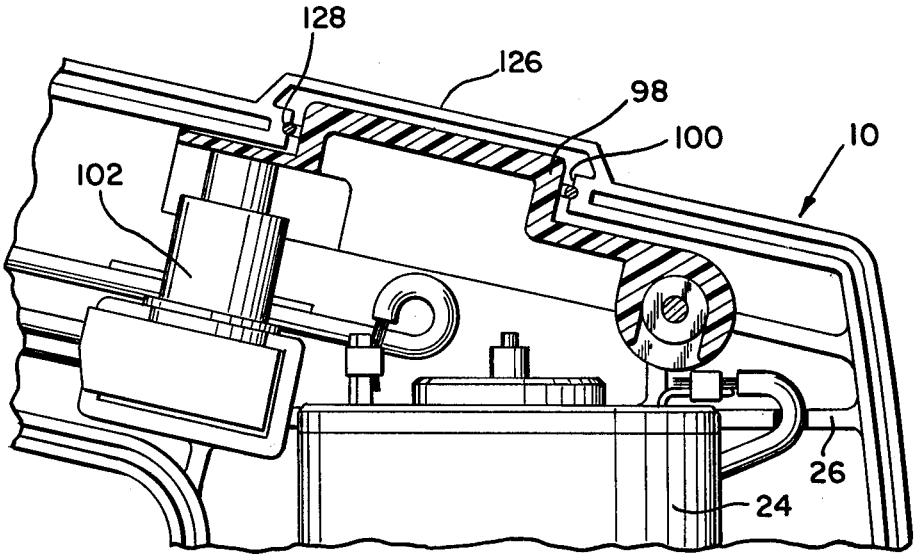
FIG. 2 is a side elevational view of a portion of the scrubber of the invention with the right housing half removed to show the actuating means.

In accordance with the invention, a drive motor is supported by the housing in the compartment and includes a motor shaft and a first drive gear mounted thereon. As seen in FIGS. 1 and 2, drive motor 24 is supported in compartment 18 by means of support ribs 26 in the two half sections 12 and 14 of housing 10. Projecting downwardly from drive motor 24 is motor shaft 28 on the end of which is mounted first drive gear 30.

Also in accordance with the invention, a combination gear is rotatably disposed on a shaft parallel to the motor shaft and includes a reduction gear driven by the first drive gear and a second drive gear coaxially and integrally formed with the reduction gear for rotation at a speed reduced from that of the first drive gear. More particularly, as seen in FIG. 1, combination gear 32 is rotatably disposed on shaft 34. The combination gear 32 includes reduction gear 36 and second drive gear 38 which is coaxially and integrally formed with reducing gear 36. Reducing gear 36 is driven by first drive gear 30 thereby rotating second drive gear 38 at a speed reduced from that of the first drive gear 30.

In accordance with the invention, a hollow, tubular output shaft is rotatably disposed in an opening in the housing having one end disposed in the compartment and an output gear is coaxially secured to one end of the output shaft and driven by the second drive gear.

As herein embodied and depicted in FIGS. 1 and 3, hollow, tubular output shaft 40 is rotatably disposed in opening 42 formed in housing 10. Opening 42 is defined by two half circular cutouts in housing halves 12 and 14 thus placing the axis of opening 42 on the plane of the seam between the two housing halves of housing 10. One end 44 of output shaft 40 is disposed in compartment 18. Output gear 46 is coaxially secured to one end 44 of output shaft 40 within compartment 18. Output gear 46 is driven by second drive gear 38.

Preferably, output gear 46 includes a depending annular flange 48 as seen in FIG. 3 which serves to limit the axial movement of output shaft 40 by slidably contacting a first thrust washer 50 be disposed around output shaft 40 and between depending flange 48 and the inner surface of housing 10 to reduce wear and friction between depending flange 48 and housing 10.

As may be seen in FIGS. 7, 8 and 9, output gear 46, depending annular flange 48 and output shaft 40 may be formed in one integral piece.

In accordance with the invention, one piece gear case means is supported by the housing in the compartment for supporting the shaft of the combination gear and rotationally supporting the output gear in fixed relationship to each other and to the drive motor. The axis to the output shaft is parallel and proximate to the motor shaft. As embodied herein and depicted in FIG. 1, the gear case means comprises a plate 52 secured to drive motor 24 by means of screws 53. Plate 52 includes an integral, cantilever extension 54 for fixedly receiving shaft 34 of combination gear 32 and an integral member 56 depending from plate 52. Integral member 56 includes an annular shoulder 58 slidably abutting one end 44 of output shaft 40 and a cylindrical bearing surface 60 received in the bore of output shaft 40 for rotatably supporting output gear 46. Preferably, cylindrical bearing surface 60 extends within the bore of output shaft 40 slightly through opening 42 in housing 10.

It is preferred that output shaft 40 and the one-piece gear case means, including cylindrical bearing surface 60, be made of a plastic having a low coefficient of friction and a high wear factor so as to permit rotation of output shaft 40 around cylindrical bearing surface 60 without the need for bearings or other friction reducing devices. It is also preferred that second thrust washer 62 be disposed between annular shoulder 58 and the one end 44 of output shaft 40. Preferably, first and second thrust washers 50,62 are metal as friction losses are less between the plastic and metal than between two moving plastic surfaces subject to high pressure forces.

The particular structure of the one-piece gear case provides significant assembly efficiencies and reduces defective products due to misalignment of shafts and gearing. As may be seen in FIG. 1, shaft 34 of combination gear 32 is in a fixed relationship with motor shaft 28 of drive motor 24 because shaft 34 is secured within the one-piece gear case that is affixed to drive motor 24. Additionally, output shaft 40 is disposed in a fixed relationship with respect to shaft 34 and motor shaft 28 because output shaft 40 rotates about cylindrical bearing surface 60 which is integrally secured to plate 52 of the gear case. Thus the relationship of the axis of motor shaft 28 and output shaft 40 is fixed and is nearly coaxial.

Use of the one-piece gear case of the invention permits substantial preassembly of all of the elements of the drive motor and gear train before incorporation into the housing 10. This eliminates complex assembly steps rendering a more efficient manufacturing process.

In accordance with the invention, attachment means on the other end of the output shaft releasably engages the attachment for rotating the attachment with the output shaft. As here embodied and depicted in FIGS. 1, 5, 6, 7, 8 and 9, the other end 64 of output shaft 40 includes a pair of cantilever beams 66 which are substantially parallel to the axis of output shaft 40 and integrally extend from the other end 64 of output shaft 40. Each beam 66 includes a transverse ridge portion 68 projecting outwardly from the axis of output shaft 40. Beams 66 are inwardly deflectable as seen by dotted lines in FIG. 6 to permit passage of beams 66 through central hole 70 of attachment 74 for releasably securing attachment 74 to output shaft 40.

Preferably, an H-shaped shield 76 axially extends from the other end 64 of output shaft 40. The central member 78 of shield 76 is disposed between and substantially parallel to cantilever beam 66. Opposed cross members 80 of shield 76 protect the sides of beam 66 without restricting deflection of beams 66 or preventing transverse ridges 68 from engaging central hole 70 of attachment 74.

The attachment means also includes a pair of opposed flat portions 82 on the surface of output shaft 40 at the other end 64. Each flat portion 82 is axially adjacent to and substantially coplanar with a respective one of the opposed cross members 80 of shield 76. Flat portions 82 engage corresponding flat portions 84 of hole 70 in attachment 74.

Preferably, attachment 74, as seen in FIGS. 10, 11 and 12, has a top surface 86, a bottom surface 88 on which a brush or pad is attached, and a central hole 70. Central hole 70 is substantially rectangular shaped for receiving the H-shaped shield 76 and cantilever beams 66. The transverse ridges 68 on beams 66 project through hole 70 and engage the bottom surface 88 (as seen in FIG. 6) on the long side 90 of hole 70. At the top surface 86 of attachment 74, central hole 70 includes a pair of opposed D-shaped steps 92 on the long side 90 of hole 70 for receiving arcuate portions 94 on the other end 64 of output shaft 40 when said flat portions 82 engage corresponding flat portions 84 which are the short sides of hole 70.

In securing attachment 74 to output shaft 40, beams 66 and shield 76 are inserted into hole 70 of attachment 74 from top side 86 toward bottom side 88. Initially ridges 68 do not contact the sides of hole 70 due to the D-shaped steps 92. Beams 66 are deflected inwardly when ridges 68 contact lands 95 formed by steps 92. Beams 66 return to their original position when ridges 68 exit hole 70 on bottom side 88 of attachment 74. The ridges engage long sides 90 of hole 70 on bottom side 88 to secure attachment 74 to output shaft 40. The distance between other end 64 of shaft 40 and ridges 68 on beams 66 corresponds to the depth of hole 70 between lands 95 and bottom side 88.

The force required to pass beams 66 through hole 70 is a function of the shape of ridges 68 and the dimensions of beams 66. Because beams 66 are relaxed at all times except when attachment 74 is being placed on or removed from output shaft 40, the problems inherent in loaded plastic springs are eliminated.

Thrust or axial loads on attachment 74 are transferred by cooperation of lands 95 with bottom surface 97 of arcuate portions 94 and by cooperation of lands 85 formed by flat portions 92 with the top side 86 of attachment 74 along short side 84 of hole 70.

Torque transfer between output shaft 40 and attachment 74 is achieved through cooperation of flat portions 82 on shaft 40 with flat portions 84 of hole 70.

In accordance with the invention, an actuator means manually accessible through an opening in the housing is provided for electrically connecting the drive motor to an electrical power source. As embodied and depicted in FIG. 2, the actuator means comprises a pivotally mounted button 98 biased outwardly through hole 100 in housing 10 which, when depressed, actuates switch 102 providing an electrical connection between a battery disposed in compartment 22 or external electrical source and drive motor 24. It may be preferred to electrically connect the leads for drive motor 24 to screws holding the two halves 12 and 14 of case 10 together. This would allow verification of the internal wiring and connections to drive motor 24 from outside the assembled waterproof device without need to charge the battery or invade the housing by electrically connecting an external power and test source through the screws.

In accordance with the invention, the scrubber also includes a one-piece seal means for sealing against liquid passage between the two halves of the housing, around the output shaft and through the opening of the actuator means. Preferably, as may be seen in FIGS. 2, 3 and 4, the one-piece seal means comprises a molded, elastomeric seal 110 in a substantially planar loop having an H-shaped cross section. The opposed edges 112, 114 of the two halves 12, 14 of housing 10 are seated between legs 116, 118 of seal 110 placing the center member 120 in compression. The center member 120 is preferably offset to one side of seal 110 to aid in assembly of the scrubber in that the deeper portion of seal 110 is pressed on one half of housing 10 and provides sufficient resistance to hold seal 110 on the housing half while the other half is screwed in place. It is also preferred that the housing halves 12 and 14 as seen in FIG. 4 have outside grooves 122, 124 for receiving leg 116 of seal 110 to substantially increase the area of seal and housing contact. The seal means include another one piece seal having an H shaped cross section for sealing the 2 housing halves around the grip portion 20.

It is preferred that the seal 110 include a flexible, thumb-sized dome 126 (FIG. 2) formed in seal 110. Dome 126 is integral with seal 110 and cooperates with seal 110 to sealingly engage the edges of housing halves 12 and 14 which define opening 100 for access to button 98. Dome 126 is sufficiently flexible to permit vertical movement for actuating button 98 without horizontal deformation at the peripheral contact area. A wire form 128 is preferably fitted in a groove of seal 110 around the inside of opening 100 to reinforce the contact area between seal 110 and the edges of housing halves 12, 14 defining opening 100.

It is preferred that seal 110 also include a seal ring 130 (FIG. 3) integrally formed within seal 110. Ring 130 sealingly engages the edges 132 of housing halves 12 and 14 which define the opening 42 in which output shaft 40 is disposed. Ring 130 includes anular element 51 engaging the outer periphery of thrust washer 50 which serves to ensure sealing contact between ring 130 and entire periphery of opening 42. Ring 130 also includes an annular V-shaped element 134 which sealingly engages the surface of output shaft 40. The V-shaped seal element 134 is slightly movable to accommodate minor misalignments of output shaft 40 with opening 42 while bridging the gap between shaft 40 and the rigid portion of seal 110. Seal element 134 is slightly biased into contact with the surface of output shaft 40 thus slightly collapsing the "V" detail. This permits a longer life of the seal since, as the seal wears due to contact with output shaft 40, the "V" detail opens to maintain contact with the output shaft. The peripheral edges 132 of housing halves 12, 14 which define opening 42 are tapered away from the axis of opening 42 for ease in inserting edges 32 into seal 110 and to provide greater sealing force between edges 132 and seal 110 proximate the periphery of opening 42.

The invention provides a scrubber that may be easily assembled and is tightly sealed against entry of foreign matter.

It will be apparent to those skilled in the art that various modifications and variations can be made in the scrubber of the invention without departing from the scope or spirit of the invention.

What is claimed:

1. A portable appliance comprising:

(a) a housing formed of two half-sections secured together and defining an internal compartment;

(b) a drive motor supported by said housing in said compartment and including a motor shaft and a first drive gear mounted thereon;

(c) a combination gear rotatably disposed on a shaft parallel to said motor shaft and including a reducing gear driven by said first drive gear and a second drive gear coaxially integrally formed with said reducing gear for rotation at a speed reduced from that of said first drive gear;

(d) a hollow, tubular output shaft rotatably disposed in an opening in said housing having one end disposed in said compartment;

(e) an output gear coaxially secured to the one end of said output shaft and being driven by said second drive gear;

(f) one-piece gear case means supported by said housing in said compartment for supporting the shaft of said combination gear and for rotationally supporting said output gear in fixed radial relationship to each other and to said drive motor, the axis of said output shaft being parallel and proximate to the axis of said motor shaft, and axial movement of said output shaft away from said gear case means being unrestricted by said gear case means;

(g) means for restricting axial movement of said output shaft away from said gear case means;

(h) attachement means integral with the other end of said output shaft for releasably engaging an attachment for rotating said attachment with said output shaft;

(i) actuator means manually accessable through an opening in said housing for electrically connecting said drive motor to an electrical power source; and (j) one-piece seal means for sealing against liquid passage between the two halves of said housing, around said output shaft, and through the opening for said actuating means.

2. The appliance as in claim 1 wherein said gear case means comprises a plate secured to said drive motor, an integral cantilever extension of said plate for fixedly receiving the shaft of said combination gear, and an integral member depending from said plate, said member including an annular shoulder for slidably abutting the one end of said output shaft and a cylinderical bearing surface received in the bore of said output shaft for rotatably supporting said output gear.

3. The appliance as in claim 2 also including a first thrust washer disposed between said output gear and said housing and a second thrust washer disposed between said annular shoulder and the one end of said output shaft.

4. The appliance as in claim 3 wherein said gear case means and said output shaft are plastic having a low coefficient of friction and a high wear factor and said thrust washers are metal.

5. The scrubber as in claim 1 wherein said seal means comprises:

(a) a molded elastomeric seal in a substantially planar loop having an H-shaped cross section, opposed edges of the two halves of said housing being seated between the legs of said seal placing the center member in compression;

(b) a flexible, thumb-sized dome integrally formed in said seal, said dome sealingly engaging the edges of said housing halves defining the opening for access to said actuator means and flexibly covering said actuator means; and (c) a seal ring integally formed in said seal, said ring sealingly engaging the edges of said housing halves defining the opening in which said output shaft is disposed, said ring including an annular V-shaped seal element sealingly engaging the surface of said output shaft.

6. A portable, electrically-powered appliance adapted to drive rotating attachments, the appliance comprising:

(a) housing formed of two half-sections secured together and defining an internal compartment;

(b) a drive motor supported by said housing in said compartment and including a motor shaft and a first drive gear mounted thereon;

(c) a one-piece combination gear including a reducing gear and a second drive gear coaxially, rotatably disposed on a common shaft, said reducing gear being driven by said first drive gear and having a diameter greater than said second drive gear;

(d) a one-piece hollow, tubular output shaft rotatably disposed in an opening in said housing, one end of said output shaft being disposed in said compartment and including a coaxial output gear driven by said second drive gear and the other end of said output shaft including attachment means for releasably engaging an attachment for rotation with said output shaft;

(e) one-piece gear case means supported by said housing in said compartment for supporting the shaft of said combination gear and rotationally supporting said output gear in fixed radial relationship to each other and to said drive motor, the axis of said output shaft being parallel and proximate to the axis of said motor shaft, and axial movement of said output shaft away from said gear case means being unrestricted by said gear case means;

(f) means for restricting axial movement of said output shaft away from said gear case means; and (g) actuator means for electrically connecting said drive motor to an electrical power source.

7. The appliance as in either claim 1 or 6 wherein said attachment means comprises:

(a) a pair of spaced, parallel cantilever beams substantially parallel to the axis of and extending from the other end of said output shaft, each said beam including a transverse ridge projecting outwardly from the axis of said shaft, said beams being inwardly deflectable to permit passage of said beams through a central hole in said attachment for releasably securing said attachment to said output shaft;

(b) an H-shaped shield axially extending from the other end of said output shaft, the central member of said shield being disposed between and substantially parallel to said cantilever beams and the opposed cross-members of said shield protecting the sides of said cantilever beams without restricting deflection of said beams or preventing said transverse ridges from engaging said central hole; and (c) a pair of opposed flat portions on the surface of said output shaft at the other end thereof, each said flat portion being axially adjacent to and substantially coplanar with a respective one of said exposed cross members of said shield for drivingly engaging corresponding flat portions of the central hole of said attachment.

8. The scrubber as in claim 7 also including an attachment having top and bottom surfaces and a central hole in the hub thereof, said central hole being substantially rectangular for receiving said H-shaped shield and cantilever beams, the transverse ridges on said beams projecting through said hole and engaging the bottom surface of said attachment at the long sides of said hole, and at the top surface of said attachment said central hole includes a pair of opposed D-shaped steps at the long sides thereof for receiving the arcuate portions of the other end of said output shaft when said flat portions engage the short sides of said central hole.

9. A portable, electrically-powered appliance adapted to drive rotating attachments comprising:

(a) a housing formed of two half-sections secured together and defining an internal compartment;

(b) a drive motor supported by said housing in said compartment and including a motor shaft and a first drive gear mounted thereon;

(c) a combination gear rotatably disposed on a shaft parallel to said motor shaft and including a reducing gear driven by said first drive gear and a second drive gear coaxially formed with said reducing gear for rotation at a speed reduced from that of first drive gear;

(d) a one-piece hollow, tubular output shaft rotatably disposed in an opening in said housing having one end disposed in said compartment and comprising:

(1) a pair of spaced, parallel cantilever beams substantially parallel to the axis of and extending from the other end of said output shaft, each said beam including a transverse ridge projecting outwardly from the axis of said shaft, said beams being inwardly deflectable to permit passage of said beams through a central hole in said attachment for releasably securing said attachment to said output shaft;

(2) an H-shaped shield axially extending from the other end of said output shaft, the central member of said shield being disposed between and substantially parallel to said cantilever beams and the opposed cross-members of said shield protecting the sides of said cantilever beams without restricting deflection of said beams or preventing said transverse ridges from engaging said central hole; and (3) a pair of opposed flat portions on the surface of said output shaft at the other end thereof, each said flat portion being axially adjacent and substantially co-planar with a respective one of said opposed cross members of said shield for drivingly engaging corresponding flat portions of the central hole of said attachment;

(e) an output gear coaxially secured to the one end of said output shaft and being driven by said second drive gear;

(f) a one-piece gear case comprising:

(1) a plate secured to said drive motor;

(2) a cantilever extension of said plate fixedly receiving the shaft of said combination gear; and (3) a cylindrical bearing surface depending from said plate and being received in the bore of said output shaft and rotatably supporting said output shaft and said output gear; and (g) actuator means manually accessible through an opening in said housing for electrically connecting said drive motor to an electrical power source.

10. The appliance as in claim 9 wherein said one-piece gear case has an annular shoulder on said cylindrical bearing surface for slidably abutting the one end of said output shaft.

11. The appliance as in claim 10 also including a first thrust washer disposed between said output gear and said housing and a second thrust washer disposed between said annular shoulder and the one end of said output shaft.

12. The appliance as in claim 11 wherein said gear case and said output shaft are plastic having a low coefficient of friction and a high wear factor and said thrust washers are metal.

13. The appliance as in either claim 1, 6 or 9 wherein said actuator means includes a button biased to project through an opening in said housing, said button being manually depressable from outside said housing to actuate said drive motor.

14. The appliance as in either claim 1, 6 or 9 wherein the housing includes a grip portion and a second internal compartment for containing a battery electrically connected to said drive motor through said actuator means.

15. The appliance as in either claim 6 or 9 also including one-piece seal means for sealing against liquid passage between the two halves of said housing, around said output shaft, and through the opening for said actuator means.

* * * * *